US009689352B2

(12) United States Patent
Turpin

(10) Patent No.: US 9,689,352 B2
(45) **Date of Patent: *Jun. 27, 2017**

(54) EXHAUST GAS RECIRCULATION (EGR) SYSTEM FOR INTERNAL COMBUSTION ENGINES

(71) Applicant: Cummins Power Generation IP, Inc., Minneapolis, MN (US)

(72) Inventor: Mark E. Turpin, Maple Grouve, MN (US)

(73) Assignee: CUMMINS POWER GENERATION IP, INC., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/132,995

(22) Filed: Apr. 19, 2016

(65) Prior Publication Data

US 2016/0230710 A1 Aug. 11, 2016

Related U.S. Application Data

(63) Continuation of application No. 14/319,207, filed on Jun. 30, 2014, now Pat. No. 9,334,834.

(51) Int. Cl.

| | |
|---|---|
| ***F02M 26/29*** | (2016.01) |
| ***F02M 35/10*** | (2006.01) |
| ***F01N 13/00*** | (2010.01) |
| ***F02B 63/04*** | (2006.01) |
| ***F01N 3/20*** | (2006.01) |
| ***F02M 26/22*** | (2016.01) |
| *F02M 26/35* | (2016.01) |

(52) U.S. Cl.

CPC ..... *F02M 26/29* (2016.02); *F01N 3/2066* (2013.01); *F01N 13/004* (2013.01); *F02B 63/04* (2013.01); *F02B 63/042* (2013.01); *F02M 26/22* (2016.02); *F02M 35/10222* (2013.01); *F02M 26/35* (2016.02)

(58) Field of Classification Search

CPC ..... F02M 25/0726; F02M 25/074; F02M 25/0717; F02M 25/072; F02M 25/0731; F02M 25/0732; F02M 25/0734; F02M 25/0737; F02M 25/0738; F02M 35/165; F02M 35/10222; F02M 35/10268; F02M 26/14; F02M 26/17; F02M 26/22; F02M 26/24; F02M 26/28; F02M 26/29; F02M 26/32; F02M 26/33; F02M 26/35; F02D 41/0047; F02D 41/0065; F01P 3/12; F01P 3/202; F01P 3/207; F01P 11/04

USPC ..... 123/568.12

See application file for complete search history.

(56) References Cited

U.S. PATENT DOCUMENTS

| | | | | |
|---|---|---|---|---|
| 6,612,293 | B2 * | 9/2003 | Schweinzer | F28D 15/0275 123/568.12 |
| 7,182,074 | B1 | 2/2007 | Redon et al. | |
| 7,380,544 | B2 | 6/2008 | Raduenz et al. | |
| 7,481,040 | B2 | 1/2009 | Lutz | |

(Continued)

*Primary Examiner* — Grant Moubry
(74) *Attorney, Agent, or Firm* — Foley & Lardner LLP

(57) ABSTRACT

An exhaust gas recirculation (EGR) system for marine internal combustion engines and other variants is provided. An internal combustion engine is coupled to an electric power generator. An exhaust aftertreatment system connected to the engine includes an exhaust gas recirculation system with an exhaust gas recirculation system having one or more cooling features to reduce an external temperature of the EGR system.

31 Claims, 3 Drawing Sheets

(56) References Cited

U.S. PATENT DOCUMENTS

| | | | | |
|---|---|---|---|---|
| 7,938,105 | B2 | 5/2011 | Gates et al. | |
| 7,958,873 | B2 | 6/2011 | Ernst et al. | |
| 7,980,231 | B1 | 7/2011 | Belter et al. | |
| 9,032,914 | B2 | 5/2015 | Sugiura et al. | |
| 9,188,037 | B2 | 11/2015 | Krauss et al. | |
| 2008/0141985 | A1 | 6/2008 | Schernecker et al. | |
| 2009/0020263 | A1* | 1/2009 | Ohsawa ..... | F28D 1/0435 165/104.11 |
| 2009/0178396 | A1 | 7/2009 | Yezerets et al. | |

* cited by examiner

EXHAUST GAS RECIRCULATION (EGR) SYSTEM FOR INTERNAL COMBUSTION ENGINES

CROSS-REFERENCE TO RELATED APPLICATIONS

This application is a continuation of U.S. patent application Ser. No. 14/319,207, filed Jun. 30, 2014, the contents of which is hereby incorporated by reference in its entirety.

BACKGROUND

The present invention relates to power systems with exhaust gas recirculation, and more particularly, but not exclusively, relates to exhaust gas recirculation systems in marine applications.

In marine power systems, operator safety is a top priority for power system designers and manufacturers. Surface temperatures of components of the power system, such as a genset, should be reduced as much as possible because marine operators are often closer to and may come in contact with components of the power system in the tight quarters and/or accompanying enclosed spaces (such as below deck) typically found in marine applications. Furthermore, it is desirable to reduce harmful exhaust gas emissions created by operation of the power system.

Some gensets employ exhaust gas recirculation (EGR) systems to assist in engine emissions management. EGR systems typically involve plumbing into and out of an exhaust gas cooler or heat exchanger that is employed to reduce the temperature of the exhaust gas as it is returned to the intake for combustion. However, the hot recirculated exhaust gas can increase the external temperatures of the EGR plumbing and EGR system to unacceptable levels. Therefore, additional contributions in this area of technology are needed.

SUMMARY

Embodiments of the present application include unique systems, methods and techniques for cooling exhaust systems in marine applications. Other embodiments include unique systems, devices, methods, and apparatus involving EGR systems. Further embodiments, forms, features, aspects, benefits, and advantages of the present application shall become apparent from the description and figures enclosed herewith.

BRIEF DESCRIPTION OF THE DRAWINGS

The description herein makes reference to the accompanying drawings wherein like reference numerals refer to like parts throughout the several views.

DETAILED DESCRIPTION OF REPRESENTATIVE EMBODIMENTS

Figure 1:
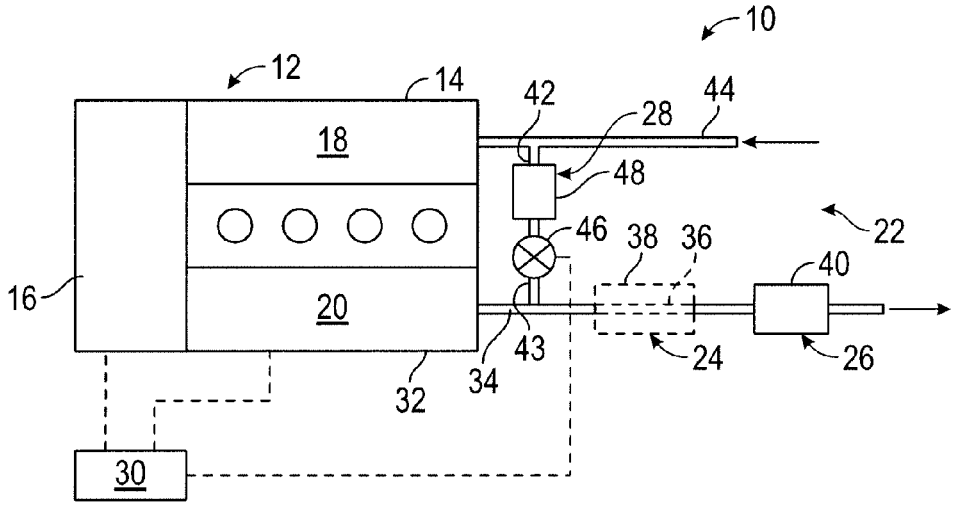
FIG. 1 is a schematic view of a power system with an EGR system according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the illustrated devices, and any further applications of the principles of the inventions illustrated and/or described being contemplated as would normally occur to one skilled in the art to which the invention relates.

FIG. 1 illustrates a power generating system 10 including a power system 12 such as a genset that may be used, for example, in marine applications. Power system 12 includes an internal combustion engine 14 that is operably connected to at least one generator 16 that provides electrical power, converting mechanical energy to electrical energy. The engine 14 may be any type of combustion or reciprocating piston type engine that uses gasoline, diesel, gaseous, hybrid fueled, or fueled in a different manner as would occur to those skilled in the art.

The generator 16 is operable to generate electrical power at a generally constant speed to provide a generally fixed AC electrical power output frequency, but may vary in speed in other arrangements or embodiments. In one embodiment, the rotational operating speed of engine 14, and correspondingly rotational speed of the generator 16 vary over a selected operating range in response to, for example, changes in electrical loading of power generating system 10. Over this range, genset rotational speed increases to meet larger power demands concomitant with an increasing electrical load on power generating system 10. For example, power system 12 may include one or more rectifiers to convert AC power from the generator 16 to DC power. Power system 12 may also include a DC bus coupled to the rectifier so equipment can utilize the DC power. Power system 12 may further include one or more inverters coupled to the DC bus to convert the DC power to AC power. Equipment requiring AC power may utilize the AC power from the inverter. In one such arrangement, a variable speed genset is utilized that provides variable frequency AC to a rectifier. The rectifier outputs a DC voltage that can be used to output DC power to other devices either through a DC/DC converter, or otherwise. This DC bus can also be used as an input to one or more inverters to provide corresponding fixed frequency AC outputs. Accordingly, a variable speed genset can be utilized to provide a fixed frequency AC output with such arrangements.

The engine 14 further includes an intake manifold 18, an exhaust manifold 20, and an exhaust system 22 connected thereto. Exhaust system 22 includes, for example, an optional catalyst assembly 24, a mixer 26, and an EGR system 28. It is contemplated that exhaust system 22 can include mufflers, turbochargers, after-treatment devices, and/or any other components for exhaust of a marine power system as would occur to those skilled in the art. Further examples of marine power and exhaust systems are disclosed, for example, in U.S. Patent Application Publication No. 2012/0060474 published on Mar. 15, 2012, which is incorporated herein by reference in its entirety for all purposes.

The operation of engine 14 and exhaust system 22 can be regulated by a controller 30, which is sometimes designated an Engine Control Module (ECM). Likewise there is a controller for operation of power system 12 that may be a part of the ECM or separate in one or more respects. In other words, one or more separate control devices may be used that are designated herein as a controller 30. Controller 30 can be responsive to control signals from sensors and execute operating logic that defines various control, management, and/or regulation functions. This operating logic may be in the form of dedicated hardware, such as a hardwired state machine, programming instructions, and/or a different form as would occur to those skilled in the art. Controller 30 may be provided as a single component, or a collection of operatively coupled components; and may be comprised of digital circuitry, analog circuitry, or a hybrid combination of both of these types. When of a multi-component form, controller 30 may have one or more components remotely located relative to the others. Controller 30 can include multiple processing units arranged to operate independently, in a pipeline processing arrangement, in a parallel processing arrangement, and/or such different arrangement as would occur to those skilled in the art. In one embodiment, controller 30 is a programmable microprocessing device of a solid-state, integrated circuit type that includes one or more processing units and memory. Controller 30 can include one or more signal conditioners, modulators, demodulators, Arithmetic Logic Units (ALUs), Central Processing Units (CPUs), limiters, oscillators, control clocks, amplifiers, signal conditioners, filters, format converters, communication ports, clamps, delay devices, memory devices, and/or different circuitry or functional components as would occur to those skilled in the art to perform the desired communications.

Exhaust manifold 20 can include a housing 32 that defined a chamber for retaining a cooling fluid such as coolant, water or seawater in marine applications, or any other suitable cooling fluid known in the art or a combination thereof for regulating the temperature of the exhaust gases from the engine 14 and the outer temperature of exhaust manifold 20. The coolant may be circulated through a coolant loop from the engine 14, or from a coolant loop dedicated to provided cooling fluid to exhaust manifold 20. The manifold housing 32 also includes a conduit 34 situated therein that defines an exhaust gas flow path that is surrounded by the cooling fluid in housing 32. Conduit 34 allows exhaust gases to flow downstream from engine 14 through the manifold 20 to the catalyst assembly 24 and/or EGR system 28.

In embodiments which utilize a catalyst, catalyst assembly 24 can be or include one or more exhaust emissions after-treatment devices. The catalyst assembly 24 includes an inner conduit 36 and a housing 38 around inner conduit 36. The inner conduit 36 contains a catalyst (not shown.) Housing 38 can define a coolant flow path and/or contain insulation that extends around conduit 36 to resist the transfer of heat from the exhaust gas passing through the catalyst. Housing 38 can be connected directly to conduit 34 or directly to exhaust manifold housing 32 with, for example, one or more flanges, gaskets and fasteners. The housings 32, 38 may be joined together or, alternatively, fabricated integrally as a single unit.

In one specific embodiment, the catalyst is a 3-way catalyst that converts carbon monoxide (CO) to carbon dioxide (CO2), reducing the CO exhaust content, among other reactions. Moreover, the catalyst may reduce other constituents (e.g., hydrocarbons and NOx) of the exhaust into more desirable gases. The catalyst may include, for example, any suitable metals known by those skilled in the art such as platinum, palladium, and/or rhodium, to name a few. Alternatively or additionally, the catalyst may convert one or more other undesired substances or constituents of the exhaust stream to one or more desired substances for discharge from power generating system 10. Additional or alternative catalytic devices can be used for treating exhaust content.

According to various embodiments, exhaust from a diesel engine can be passed through additional or alternate catalytic devices including a diesel oxidation catalyst (DOC), a selective catalyst reduction (SCR), a diesel particulate trap (DPT), etc. For example, a SCR system can be used with a catalyst and an associated system that can reduce NOx to nitrogen, oxygen, and water. The SCR can include an arrangement for injecting ammonia, urea, or similar reductant into the exhaust stream ahead of the catalyst. In another example, a DPT with an associated system can be used to ignite the particulate for disposal via combustion that may be one of various methods including, but not limited to, fuel injection into the engine combustion chamber, rid type air heater, or fuel injection into the DPT.

In another embodiment, exhaust from a gasoline engine can be passed through additional or alternate catalytic devices including a 2-way catalyst that can combine CO with HC to produce CO2 and water.

In some embodiments, no exhaust emissions after-treatment devices may be used, and EGR system 28 may be used without such devices. In other embodiments, a single exhaust emissions after-treatment device may be utilized in tandem with EGR system 28 (e.g., a partial oxidation catalyst, SCR catalyst with urea injection, particular filter, etc.). In still further embodiments, multiple (e.g., two or more) exhaust emissions after-treatment devices may be utilized with EGR system 28. All such variations are contemplated within the present disclosure.

The outlet of the catalyst assembly 24 is coupled to the mixer 26. Alternatively, the outlet of exhaust manifold 20 can be connected directly to mixer 26 without an intervening catalyst. Conduit 36 can be connected to a housing 40 of mixer 26, or, if a catalyst is provided, housings 38, 40 can be connected directly to one another with, for example, flanges, gaskets and/or fasteners. Mixer 26 is configured to mix water or seawater with the exhaust to provide additional exhaust cooling.

EGR system 28 includes an EGR system inlet 43, an EGR system 48, and an EGR system outlet 42 that connect exhaust conduit 34 to an intake conduit 44. EGR system 28 further includes an EGR control valve 46 in either an EGR inlet 43 or an EGR outlet 42. EGR control valve 46 is operably connected to controller 30 and is operable to receive control signals from controller 30 to control that amount of exhaust gas that is recirculated. Additional sensors including, but not limited to, an exhaust temperature sensor or pressure sensor, may be used to provide input to the controller 30. As discussed further below, EGR inlet 43, EGR outlet 42, and EGR system 48 receive the recirculated exhaust gas and also a cooling fluid to cool the recirculated exhaust gas before it is mixed with the intake air flow in intake conduit 44. The cooling fluid may be coolant, water or seawater in marine applications, or any other suitable cooling fluid known in the art or a combination thereof for regulating the temperature of the recirculated exhaust gases from exhaust manifold 20. The cooling fluid for one or both of EGR inlet 43 and EGR outlet 42 may be the same type of cooling fluid, or may be a different cooling fluid. Furthermore, EGR system 48 may receive the same type of cooling fluid as one or both of EGR inlet 43 and EGR outlet 42, or a different type of cooling fluid. The coolant may be circulated through a coolant loop from the engine 14, may be provided from a coolant loop dedicated solely to any one or combination of EGR inlet 43, EGR outlet 42, and EGR system 48, or from a coolant loop that is connected to exhaust manifold 20 or mixer 26.

In certain instances, exhaust catalytic converters operate more efficiently when the catalyst assembly 24 is at higher operating temperatures. However, in marine applications, it may be desirable to limit the surface temperature of the exhaust system components for the safety of the watercraft's users. Accordingly, the external temperatures of EGR system 48 and the EGR inlet 43 and EGR outlet 42 thereto may be maintained at an acceptable surface temperature.

In some embodiments, EGR system 28 may be or include a cooled EGR system configured to cool exhaust, such as to gain better emissions characteristics and/or NOx reduction. In some embodiments, EGR system 28 may be or include a hot EGR system configured to produce hot exhaust gas recirculation. In both types of EGR systems, the features of the present disclosure may be utilized to cool outer surface components of EGR system 28, such as to meet requirements for marine engine compartment use.

Figure 2:
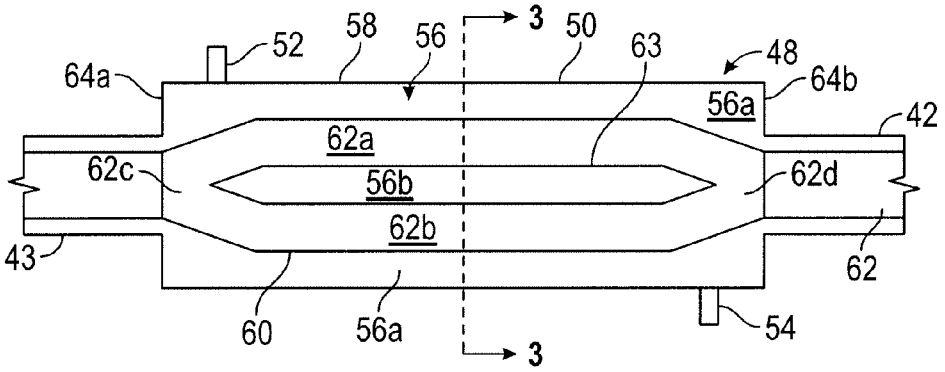
FIG. 2 is a diagrammatic view in longitudinal section of one embodiment of an EGR system of the EGR system of FIG. 1.
Figure 3:
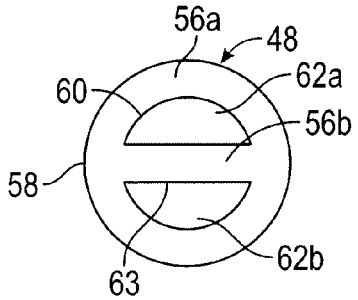
FIG. 3 is a diagrammatic section view of the EGR system along line 3-3 of FIG. 2.
Figure 4:
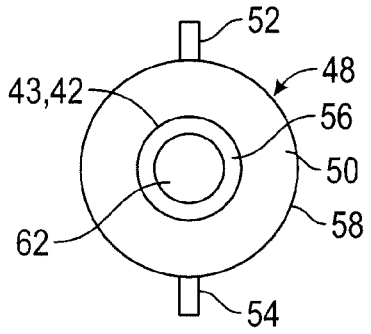
FIG. 4 is a diagrammatic end view of the EGR system of FIG. 2.

Referring to FIGS. 2-4, additional details of one embodiment of EGR system 48, EGR inlet 43, and EGR outlet 42 are shown. EGR system 48 includes an external housing 50 defining one or more internal cooling passages 56 that extend between and connect a cooling fluid inlet 52 and a cooling fluid outlet 54. Cooling passage 56 includes an outer portion 56*a* that is defined between an outer wall 58 and an inner wall 60 of housing 50. The cooling fluid in outer portion 56*a* maintains the outer wall 58 at an acceptable temperature level. Inner wall 60 of housing 50 surrounds the exhaust flow passage 62. Exhaust flow passage 62 is separated in housing 50 by internal wall structure 63 into two or more exhaust flow passage portions 62*a*, 62*b*. Internal wall structure 63 can define one or more inner cooling passage portions 56*b*. Cooling fluid can flow into inner cooling passage portions 56*b* and assist the cooling fluid in outer portion 56*a* in cooling the exhaust gasses in exhaust flow passage portions 62*a*, 62*b* while remaining fluidly isolated from cooling passage 56.

Exhaust flow passage 62 includes opposite inlet and outlet portions 62*c*, 62*d* that are defined by the respective ends of housing 50 to provide a transition into the exhaust flow passage portions 62*a*, 62*b*. In the illustrated embodiment, inlet and outlet portions 62*c*, 62*d* are tapered from the flow passage portions 62*a*, 62*b* to the respective EGR inlet 43 and EGR outlet 42, and inlet and outlet portions 62*c*, 62*d* are defined by inner wall 60 of housing 50. Other configurations for inlet and outlet portions 62*c*, 62*d* are also contemplated, such as stepped configurations, flared configurations, and other suitable transitions between the portions of exhaust flow passage 62 defined by EGR inlet 43, EGR outlet 42, and the plurality of exhaust flow passage portions 62*a*, 62*b* defined by EGR system 48. In the illustrated embodiment, housing 50 includes a circular cross-section such as shown in FIG. 3. It should be understood that any suitable configuration for the housing discussed herein are contemplated, including non-circular, rectangular, oval, square, and irregular cross-sectional shapes.

Housing 50 forms an elongated and continuous jacket that defines internal cooling passage 56 so that the outer portion 56*a* of internal cooling passage 56 also extends along the inlet and outlet portions 62*c*, 62*d* of exhaust flow path 62 and along the respective EGR inlet 43 and EGR outlet 42. Thus, EGR inlet 43 and EGR outlet 42 include a dual outer wall configuration, such as shown in FIG. 4, that receives a flow of cooling fluid from internal cooling passage 56 to cool the outer surface portions of EGR inlet 43 and EGR outlet 42. In other arrangements, EGR inlet 43 and/or EGR outlet 42 include separate inlets and outlets to receive a separate flow of cooling fluid and are fluidly isolated from cooling passage 56. Outer wall 58 of housing 50 extends between opposite end walls 64*a*, 64*b* of housing 50 and defines a jacket forming cooling passage 56 extending between end walls 64*a*, 64*b* and outer and inner walls 58, 60. The jacket provides cooling fluid flow below the external surfaces of EGR system 48 that extend along the inlet and outlet portions 62*c*, 62*d* of exhaust flow passage 62 from the connection of end walls 64*a*, 64*b* of housing 50 to the respective EGR inlet and outlet 43, 42. Thus, the connections of EGR system 48 with EGR inlet 43 and EGR outlet 42 are externally cooled with cooling fluid.

Figure 5:
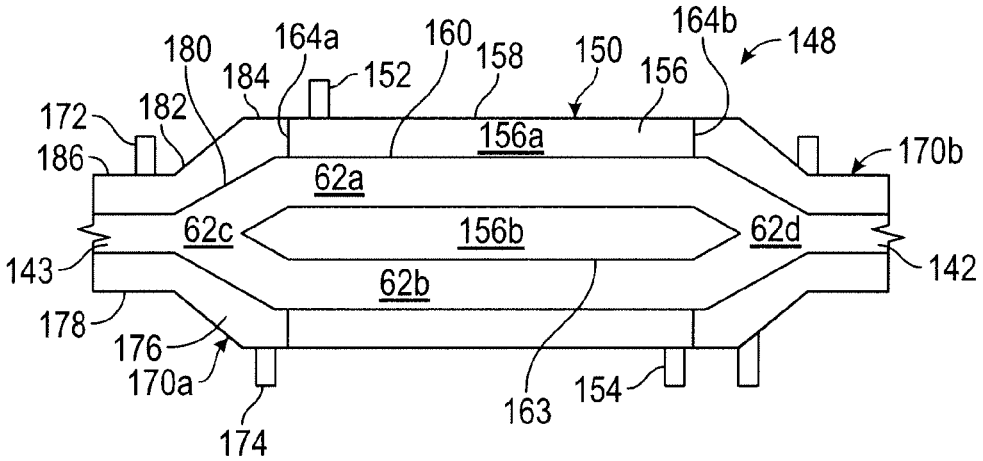
FIG. 5 is a diagrammatic longitudinal section view of another embodiment of an EGR system.

Referring to FIG. 5, another embodiment EGR system 148 connected with another embodiment EGR inlet 143 and EGR outlet 142 is shown. EGR system 148 includes an external housing 150 defining one or more internal cooling passages 156 that extend between and connect a cooling fluid inlet 152 and a cooling fluid outlet 154. Cooling passage 156 includes an outer portion 156*a* that is defined between an outer wall 158 and an inner wall 160 of housing 150. Inner wall 160 of housing 150 surrounds the exhaust flow passage 62. Exhaust flow passage 62 separates in housing 150 into two or more exhaust flow passage portions 62*a*, 62*b* around an internal wall structure 163 that defines one or more inner cooling passage portions 156*b*. Cooling fluid can flow into inner cooling passage portions 156*b* and assist the cooling fluid in outer portion 156*a* in cooling the exhaust gasses in exhaust flow passage portions 62*a*, 62*b*.

EGR system 148 also includes an inlet jacket 170*a* and an outlet jacket 170*b* that extend along respective ones of the EGR inlet 143 and EGR outlet 142. Jackets 170*a*, 170*b* can be configured similarly to one another, and a separate description of the details of jacket 170*b* is not provided herein, it being understood that the description of jacket 170*a* is applicable thereto. Jackets 170*a*, 170*b* are mounted, fixed or otherwise extend from respective ones of the end walls 164*a*, 164*b* of housing 150 and receive cooling fluid therethrough. Jackets 170*a*, 170*b* receive a cooling fluid flow that provides cooling of the external surfaces of the EGR system 148 in response to the exhaust gas flow in the inlet and outlet transition portions 62*c*, 62*d* to passage portions 62*a*, 62*b*, while cooling fluid in passage portion 156*a* of housing 150 provides cooling of the external surfaces of housing 150.

In the illustrated embodiment, jackets 170*a*, 170*b* include a coolant inlet 172 and a coolant outlet 174 that are in flow communication with an internal cooling chamber 176. Cooling chamber 176 is defined by an outer wall 178 and an inner wall 180 of the jacket 170*a*, 170*b*. Walls 178, 180 include a generally frusto-conical type configuration, and each includes a transition portion 182 that is tapered between a cylindrical or tubular first end portion 184 that is mounted to the respective end wall 164*a*, 164*b* of EGR system housing 150 and an opposite cylindrical or tubular second end portion 186 that is connected to the respective EGR inlet 143 and EGR outlet 142. Other configurations for one or both of the outer and inner walls 178, 180 are also contemplated, such as stepped configurations, flared configurations, and other suitable transitions between the portions of exhaust flow passage 62 defined by EGR inlet 143 and EGR outlet 142 and the plurality of exhaust flow passage portions 62*a*, 62*b* defined by EGR system 148. Since the cooling chamber 176 of jackets 170*a*, 170*b* extends along the inlet and outlet portions 62*c*, 62*d* and along the EGR inlet 143 and EGR outlet 142, the connections of EGR system 148 with the exhaust conduit 34 (or exhaust manifold 20) and the intake conduit 44 and the transitions 62*c*, 62*d* of exhaust flow passage 62 to exhaust flow passage portions 62*a*, 62*b* in EGR system 148 are externally cooled with cooling fluid.

Figure 6:
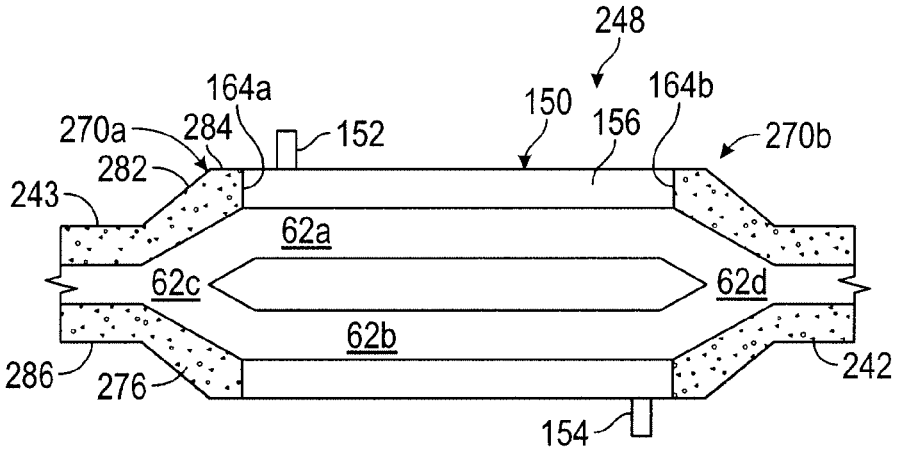
FIG. 6 is a diagrammatic longitudinal section view of another embodiment of an EGR system.

Referring now to FIG. 6, there is shown another embodiment of an EGR system 248. EGR system 248 includes a housing 150 that can be configured the same as the housing of EGR system 148 discussed above. In addition, EGR system 248 includes an inlet jacket 270*a* and an outlet jacket 270*b*. Jackets 270*a*, 270*b* each house insulation 276 that extends around the exhaust flow passage transition portions 62*c*, 62*d* and EGR inlet 243 and EGR outlet 242 to control heating of the external surfaces of EGR system 248 along the exhaust flow passage transitions 62*c*, 62*d* into and out of housing 150. Jackets 270*a*, 270*b* can be configured similarly to one another, and a separate description of the details of jacket 270*b* is not provided herein, it being understood that the description of jacket 270*a* is applicable thereto.

Jackets 270*a*, 270*b* each include insulation material 276. The insulation material 276 can define the interior and exterior surfaces of jackets 270*a*, 270*b*, or jackets 270*a*, 270*b* can include separate inner and outer walls that extend along and sandwich the insulation material 176 therebetween. Jackets 270*a*, 270*b* are mounted to respective ones of the end walls 164*a*, 164*b* of housing 150 and prevent heat from the exhaust gas in the inlet and outlet portions 62*c*, 62*d* of exhaust flow passage 62 and in EGR inlet 243 and EGR outlet 242 from transferring to the exterior surface of jackets 270*a*, 270*b*, or at least control the heat transfer to acceptable levels. Some known types of thermal insulation that may be used are Unitrax Isofraxe QSP™ Insulation, QSP Cone insulation, Vitreous Aluminosilicate Fiber, RCF, ceramic fiber, synthetic vitreous fiber (SVF), man-made vitreous fiber (MMVF), or man-made mineral fiber (MMMF).

In the illustrated embodiment, jackets 270*a*, 270*b* include a generally frusto-conical type configuration, and each includes a transition portion 282 that is tapered between a tubular or cylindrical first end portion 284 that is mounted to the respective end wall 164*a*, 164*b* of EGR system housing 150 and an opposite tubular or cylindrical second end portion 286 that is connected to and extends around the respective EGR inlet 243 and EGR outlet 242. Other configurations for jackets 270*a*, 270*b* are also contemplated, such as stepped configurations, flared configurations, and other suitable transitions between the portions of exhaust flow passage 62 defined by EGR inlet 243 and EGR outlet 242 and the plurality of exhaust flow passage portions 62*a*, 62*b* defined by EGR system 248. Since the insulation of jackets 270*a*, 270*b* extends along the inlet and outlet portions 62*c*, 62*d* and the EGR inlet 243 and EGR outlet 242, the connections of EGR system 248 with exhaust conduit 34 (or manifold 20) and intake conduit 44 and the transitions of exhaust flow passage 62 to exhaust flow passage portions 62*a*, 62*b* in EGR system 248 are externally insulated.

Figure 7:
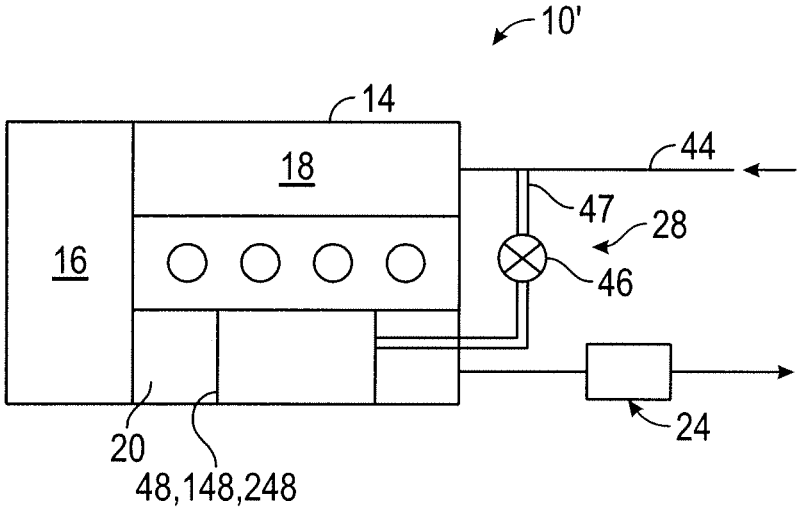
FIG. 7 is a schematic view of a power system with another embodiment EGR system.

In addition to being connectable through EGR inlet 43, 143, 243 and/or EGR outlet 42, 142, 242 as discussed in the EGR system embodiments above, the EGR systems 48, 148, 248 can be directly connected to other portions of the power generating system 10. For example, in FIG. 7, another embodiment power generating system 10' includes one of EGR systems 48, 148, 248 connected directly to or incorporated into exhaust manifold 18. EGR valve 46 can be located downstream of the EGR system or incorporated into exhaust manifold 20. The cooling fluid circulated in exhaust manifold 18 can be circulated through EGR system 48, 148, 248, or separate cooling fluid inlets and outlets can be provided. EGR control valve 46 can also be provided in a separate EGR conduit 47 as shown, or incorporated directly into the outlet of EGR system 48, 148, 248. The EGR conduit 47 can be insulated and/or jacketed to limit external temperatures.

Figure 8:
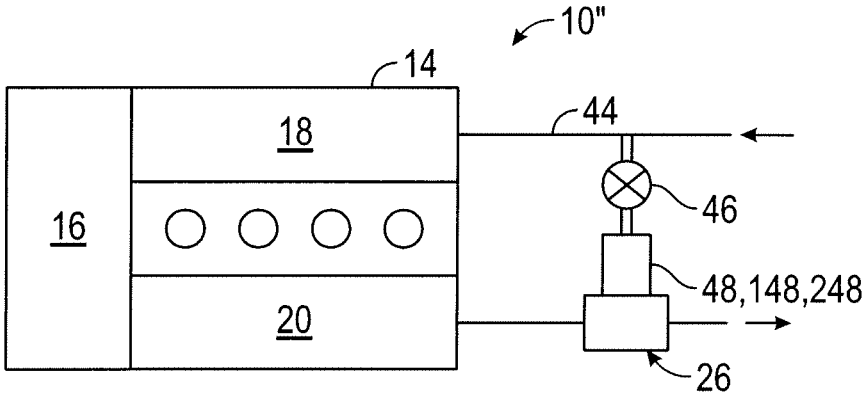
FIG. 8 is a schematic view of a power system with another embodiment EGR system.

In another example shown in FIG. 8, another embodiment power generating system 10" includes one of EGR systems 48, 148, 248 connected directly to or incorporated into mixer 26. The cooling fluid can be circulated from the EGR system 48, 148, 248 to mixer 26 for mixing with exhaust. Alternatively, a separate fluid supply can be provided to mixer 26 and EGR system 48, 148, 248.

Various aspects of the disclosure herein are contemplated. According to one aspect, a system, method and apparatus includes a marine genset with an internal combustion engine and an electric power generator mechanically driven by the engine. An intake system is connected to the engine to provide a charge flow to the engine and an exhaust manifold is connected to the engine to receive exhaust from the engine. In some embodiments, an exhaust emission after-treatment device may be positioned in fluid communication with the exhaust manifold to receive exhaust therefrom. In some embodiments, the exhaust emission after-treatment device may include a catalyst to reduce one or more exhaust constituents. There is further an exhaust gas recirculation system including an exhaust gas recirculation system to receive exhaust from the exhaust manifold through an exhaust conduit and to provide exhaust flow from the exhaust gas recirculation system to the intake system through the exhaust conduit. The exhaust gas system includes a housing defining a plurality of exhaust flow passages in fluid communication with the exhaust conduit. The housing further defines an outer cooling passage portion around the plurality of exhaust flow passages and at least one inner cooling passage portion between the plurality of exhaust flow passages. A cooling fluid circulates through the outer cooling passage portion to reduce an outer temperature of the exhaust gas recirculation system while reducing a temperature of the recirculated exhaust in the plurality of exhaust flow passages during operation of the engine.

According to one embodiment, the exhaust gas recirculation system includes a cooling fluid inlet and a cooling fluid outlet that are each in fluid communication with the outer cooling passage portion. In another embodiment, the outer and inner cooling passage portions are fluidly isolated from the plurality of exhaust flow passages. In another embodiment, the housing of the exhaust gas recirculation system is connected to a housing of the exhaust manifold. In yet another embodiment, there is further provided a mixer downstream of the exhaust emission after-treatment device(s) and the housing of the exhaust gas recirculation system is connected to the mixer via after-treatment device(s).

In yet another embodiment, the exhaust conduit defines an exhaust flow passage and the exhaust gas recirculation system includes an inlet portion in which the exhaust flow passage transitions to the plurality of exhaust flow passages defined by the housing and an outlet portion in which the plurality of exhaust flow passages transition to the exhaust flow passage defined by the exhaust conduit. In one refinement of this embodiment, the outer cooling passage portion extends along the inlet portion and the outlet portion of the exhaust gas recirculation system. In a further refinement, the housing includes an outer wall extending around an inner wall with the outer and inner walls defining the outer cooling passage portion therebetween, and the inner wall extends around the plurality of exhaust flow passages. In still a further refinement, the outer wall, the inner wall and the outer cooling passage portion extend between opposite end walls of the housing.

In another refinement of the previous embodiment, there is further provided a first insulation jacket extending from a first end of the housing around the inlet portion and a second insulation jacket extending from a second end of the housing around the outlet portion. In a further refinement, each of the first and second insulation jackets includes a first end portion extending around the plurality of exhaust flow passages defined by the housing, a second end portion extending around the exhaust flow passage defined by the exhaust conduit, and a tapered transition portion extending between the first end portion and the second end portion. In yet a further refinement, each of the first and second insulation jackets includes an inner wall and an outer wall extending along opposite sides of insulation material between the inner and outer walls.

In yet another refinement of the previous embodiment, there is further provided an inlet jacket defining a first cooling passage around the inlet portion and an outlet jacket defining a second cooling passage around the outlet portion with cooling fluid in the first and second cooling passages. In a further refinement, the inlet jacket and the outlet jacket each include a cooling inlet and a cooling outlet in fluid communication with respective ones of the second cooling passage and the third cooling passage. In yet another further refinement, each of the inlet jacket and the outlet jacket includes a first end portion extending around the plurality of exhaust flow passages defined by the housing, a second end portion extending around the exhaust flow passage defined by the exhaust conduit, and a tapered transition portion extending between the first end portion and the second end portion. In still another further refinement, the first cooling passage and the second cooling passage are fluidly isolated from the inner and outer cooling passage portions of the housing.

According to another aspect, there is provided an internal combustion engine operable at a speed, an electrical power generator operably connected to the engine to produce electric power, an exhaust emissions after-treatment device including a catalyst for reducing one or more constituents of an exhaust stream received from the engine, and an exhaust gas recirculation system for recirculating exhaust gas produced by the engine to an intake of the engine. The exhaust gas recirculation system includes a system for cooling the recirculating exhaust gas. The system includes a housing extending between an inlet portion and an outlet portion. The housing includes an inner wall and an outer wall spaced from the inner wall by an outer cooling passage portion for receiving a cooling fluid to cool the outer wall. The housing further defines a plurality of exhaust passageways between the inlet portion and the outlet portion with the inner wall extending around the plurality of exhaust passageways. The housing also defines at least one inner cooling passage portion between the plurality of exhaust passageways for receiving the cooling fluid to cool the recirculating exhaust gas in the plurality of exhaust passageways.

According to one embodiment, the inlet portion and the outlet portion each extend along a respective transition of an exhaust flowpath from a single exhaust passageway defined by an exhaust conduit to the plurality of exhaust passageways defined by the housing. In one refinement, the outer cooling passage portion extends along the inlet portion and the outlet portion. In another refinement, the inlet portion and the outlet portion each includes a cooling jacket extending from respective opposite ends of the housing. Each cooling jacket defines a cooling passage for receiving cooling fluid with the cooling passages of the inlet portion and the outlet portion fluidly isolated from the outer cooling passage portion defined by the housing. In yet another refinement, the inlet portion and the outlet portion each includes an insulation jacket extending from respective opposite ends of the housing.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

an exhaust manifold structured to be connected to a marine engine;

an intake system structured to be connected to the marine engine; and an exhaust gas recirculation (EGR) system, the EGR system comprising:

an inlet structured to receive an exhaust gas from the exhaust manifold;

an outlet structured to provide the exhaust gas to the intake system; and a housing defining:

a plurality of exhaust flow passages in fluid communication with the inlet and the outlet;

an outer cooling passage portion around the plurality of exhaust flow passages; and at least one inner cooling passage portion between the plurality of exhaust flow passages, wherein a cooling fluid circulates through the outer cooling passage portion to reduce an outer temperature of the EGR system while reducing a temperature of the exhaust gas in the plurality of exhaust flow passages.

2. The apparatus of claim 1, further comprising a first transition from the inlet into the plurality of exhaust flow passages, and a second transition from the outlet into the plurality of exhaust flow passages.

3. The apparatus of claim 1, wherein the outer cooling passage portion extends along the inlet and the outlet.

4. The apparatus of claim 1, wherein the inlet includes an inlet jacket defining a first cooling passage around the inlet, and wherein the outlet includes an outlet jacket defining a second cooling passage around the outlet.

5. The apparatus of claim 1, wherein the inlet includes a first insulation jacket extending from a first end of the housing, and wherein the outlet includes a second insulation jacket extending from a second end of the housing.

6. The apparatus of claim 1, further comprising an exhaust emissions after-treatment device including a catalyst for reducing one or more constituents of the exhaust gas received from the marine engine.

7. A system, comprising:

an inlet structured to receive an exhaust gas from an exhaust manifold connected to an engine;

an outlet structured to provide the exhaust gas to an intake system connected to the engine; and a housing defining:

a plurality of exhaust flow passages in fluid communication with the inlet and the outlet;

an outer cooling passage portion around the plurality of exhaust flow passages; and at least one inner cooling passage portion between the plurality of exhaust flow passages, wherein a cooling fluid circulates through the outer cooling passage portion to reduce an outer temperature of the system while reducing a temperature of the exhaust gas in the plurality of exhaust flow passages.

8. The system of claim 7, further comprising a cooling fluid inlet and a cooling fluid outlet that are each in fluid communication with the outer cooling passage portion.

9. The system of claim 7, wherein the outer cooling passage portion and the at least one inner cooling passage portion are each fluidly isolated from the plurality of exhaust flow passages.

10. The system of claim 7, further comprising:

an inlet portion that provides a first transition from the inlet into the plurality of exhaust flow passages; and an outlet portion that provides a second transition from the outlet into the plurality of exhaust flow passages.

11. The system of claim 10, further comprising:

an inlet jacket defining a first cooling passage around the inlet; and an outlet jacket defining a second cooling passage around the outlet;

wherein the cooling fluid flows in the first cooling passage and the second cooling passage.

12. The system of claim 11, wherein the inlet jacket includes a first cooling inlet and a first cooling outlet in fluid communication with the first cooling passage, and wherein the outlet jacket includes a second cooling inlet and a second cooling outlet in fluid communication with the second cooling passage.

13. The system of claim 11, wherein each of the inlet jacket and the outlet jacket includes:

a first end portion extending around the plurality of exhaust flow passages enclosed by the housing;

a second end portion extending around one of the inlet or the outlet; and a tapered transition portion extending between the first end portion and the second end portion.

14. The system of claim 11, wherein the first cooling passage and the second cooling passage are each fluidly isolated from the outer cooling passage portion and the at least one inner cooling passage portion.

15. The system of claim 10, wherein the outer cooling passage portion extends along an exterior of the inlet and the outlet.

16. The system of claim 15, wherein the housing includes:

an inner wall extending around the plurality of exhaust flow passages; and an outer wall extending around the inner wall, wherein the outer cooling passage portion is formed between the inner wall and the outer wall.

17. The system of claim 16, wherein the outer wall, the inner wall, and the outer cooling passage portion extend between opposite end walls of the housing.

18. The system of claim 10, further comprising:

a first insulation jacket around the inlet extending from a first end of the housing; and a second insulation jacket around the outlet extending from a second end of the housing.

19. The system of claim 18, wherein each of the first and second insulation jackets includes:

a first end portion extending around the plurality of exhaust flow passages enclosed by the housing, a second end portion extending around one of the inlet or the outlet, and a tapered transition portion extending between the first end portion and the second end portion.

20. The system of claim 19, wherein insulation material is disposed in the first insulation jacket and the second insulation jacket.

21. The system of claim 7, wherein the housing of system is connected to a housing of the exhaust manifold.

22. The system of claim 7, further comprising an exhaust emission after-treatment device in fluid communication with the exhaust manifold, the exhaust emission after-treatment device structured to receive the exhaust gas from the exhaust manifold, the exhaust emission after-treatment device including a catalyst to reduce one or more exhaust constituents in the exhaust gas.

23. The system of claim 22, further comprising a mixer downstream of the exhaust emission after-treatment device, wherein the housing of the EGR system is connected to the mixer.

24. The system of claim 7, further comprising:

the engine; and an electric power generator mechanically driven by the engine.

25. The system of claim 7, wherein the engine is a marine engine.

26. The system of claim 25, wherein the cooling fluid includes seawater.

27. The system of claim 7, wherein the system is used in marine applications.

28. The system of claim 27, wherein the system is used in a tight quarter, an enclosed space, or a marine compartment.

29. A method of cooling an exhaust gas, the method comprising:

providing an exhaust gas recirculation (EGR) system, the EGR system comprising:

an inlet structured to receive an exhaust gas from an exhaust manifold connected to a marine engine;

an outlet structured to provide the exhaust gas to an intake system connected to the marine engine; and a housing defining:

a plurality of exhaust flow passages in fluid communication with the inlet and the outlet;

an outer cooling passage portion around the plurality of exhaust flow passages; and at least one inner cooling passage portion between the plurality of exhaust flow passages, receiving, at the inlet, the exhaust gas from the exhaust manifold;

directing the exhaust gas from the inlet into the plurality of exhaust flow passages;

circulating a cooling fluid through the outer cooling passage portion and the at least one inner cooling portion to cool the EGR system and the exhaust gas in the plurality of exhaust flow passages;

directing the exhaust gas from the plurality of exhaust flow passages to the outlet; and providing, at the outlet, the exhaust gas to the intake system.

30. The method of claim 29, further comprising:

providing an inlet jacket that defines a first cooling passage around the inlet and an outlet jacket that defines a second cooling passage around the outlet; and circulating the cooling fluid through the first cooling passage and the second cooling passage.

31. The method of claim 29, further comprising:

providing a first insulation jacket extending from a first end of the housing around the inlet, and a second insulation jacket extending from a second end of the housing around the outlet; and providing insulation material in the first insulation jacket and the second insulation jacket.

* * * * *